United States Patent [19]

Wirt

[11] 4,371,054

[45] Feb. 1, 1983

[54] FLOW DUCT SOUND ATTENUATOR

[75] Inventor: Leslie S. Wirt, Newhall, Calif.

[73] Assignee: Lockheed Corporation, Burbank, Calif.

[21] Appl. No.: 106,186

[22] Filed: Dec. 21, 1979

Related U.S. Application Data

[63] Continuation of Ser. No. 887,191, Mar. 16, 1978, abandoned.

[51] Int. Cl.[3] ..... F01N 1/10

[52] U.S. Cl. ..... 181/252; 181/255; 181/272; 181/273

[58] Field of Search ..... 181/222, 224, 231, 248–250, 181/255, 256, 257, 258, 264, 266, 269, 273, 276, 247, 252, 272

[56] References Cited

U.S. PATENT DOCUMENTS

| | | | |
|---|---|---|---|
| 1,878,424 | 9/1932 | Oldberg | 181/250 |
| 2,998,860 | 9/1961 | Everett | 181/257 |
| 3,033,307 | 5/1962 | Sanders et al. | 181/224 |
| 3,142,354 | 7/1964 | Kammerer et al. | 181/252 |
| 3,590,946 | 7/1971 | Corn, Jr. | 181/256 |
| 3,920,095 | 11/1975 | Clark | 181/248 |

*Primary Examiner*—L. T. Hix

*Assistant Examiner*—Benjamin R. Fuller

*Attorney, Agent, or Firm*—Frederic P. Smith

[57] ABSTRACT

An acoustical silencer for a gas passage or exhaust duct for a gas turbine engine, which is composed of three parts. The first comprises an absorptive surface to absorb incident low frequency sound the second comprises an acoustically lined duct attenuating high frequency sound transmitted therethrough. The entrance to the first part and the entrance to the second part are essentially coplanar. The third part is a horn-shaped plenum or conical diffuser to contain the flow and distribute the sound over the entry surface of the first part and the entrance to the second part. The entrances to both the first and second parts, being coplanar, present acoustically parallel paths to sound impinging on their common plane. The input impedances of the absorptive surface of the first part and the entrance to the second part are adjusted such that a disproportionately larger share of the incident low frequency acoustical energy passes into the first part and is dissipated. At higher frequencies, an area proportionate share of incident acoustical energy may be absorbed by the first part and the remainder which enters the second part is attenuated by the lined duct portion of the second part.

19 Claims, 7 Drawing Figures

FLOW DUCT SOUND ATTENUATOR

This is a continuation of application Ser. No. 887,191 filed Mar. 16, 1978 now abandoned.

BACKGROUND OF THE INVENTION

Many gas passage ducts, such as air conditioning ducts, gas turbine inlet or exhaust ducts, and the like, are required to attenutate sound while at the same time being required to transmit gaseous flow with a minimum of back pressure. In the past, it has been customary to line the interior wall of such ducts with acoustical material, such as fiberglass, to absorb the unwanted sound. Such lined ducts are capable of efficiently attenuating higher frequency sounds, but would fail to attenutate lower frequency sounds and, hence, are often unsatisfactory. The reason for the failure to absorb low frequency sound is that for such an acoustical liner to become an efficient absorber of low frequencies, the liner must be quite thick, on the order of one-fourth the wave length of the sound. Commonly, this amounts to more than 0.75 meters of depth. Space is seldom available for such liner thickness. Additionally, a liner of such a thickness would be of significant weight and expense.

It is known that low frequency noise can be attenuated provided there is an expansion chamber. Such an expansion chamber is often called a surge tank and is added to the system in series with the lined duct section. To be effective, however, the expansion chamber must be quite large in diameter and the series connection of the two dissimilar acoustical components considerably increases its total length. Again, space is seldom available and the expense and weight can be prohibitive.

SUMMARY OF THE INVENTION

The structure of this invention comprises a sound attenuator which is designed in particular for a fluid conducting duct such as the exhaust duct for a gas turbine engine. Prior to the gaseous exhaust of the engine being discharged into the ambient air, the gas is conducted into a plenum chamber, whose cross-sectional area is larger than the initial duct. To minimize back pressure, this plenum chamber is preferably formed so the cross-sectional area gradually increases in the manner conventional to both flow diffusers and simple acoustical horns. The gas flow, which is now reduced in velocity due to the increased cross-sectional area, and the sound which is somewhat reduced in intensity by virtue of being distributed over the same increased area, arrive together at a transverse plane. This plane is defined by the preferably bellmouthed entrance to a continuing duct and by the entrance to the low frequency absorptive structure. In one convenient construction, the bellmouthed duct which provides the continuing flow path is round and located coaxially within an annular shaped low frequency absorber but any other cross-sectional shape of low frequency absorber will also function and the continuing duct need not be centrally located. At the transverse plane, the gas flow and sound are partially separated. The entire gas flow must enter the continuing duct. This requires its partial reacceleration which is accomplished with minimal pressure drop in the preferred constructions by means of the bellmouth entrance. The sound field encounters two alternate propagation paths at the transverse plane and divides in accordance with the acoustical properties of the two possible alternate and parallel paths. At any given frequency, the partition of the incident sound energy between the two alternate paths is governed by two factors, the relative area of the continuing duct and the outer sound absorbing structure, and the separate acoustic impedances of the continuing duct entrance and the sound absorbing structure. If the specific acoustic impedance of the two alternate paths happens to be the same, then the ratio of the energy entering the continuing duct and the sound absorptive transverse surface will be simply the ratio of the areas of the continuing duct and the absorptive surface. However, to the extent that the acoustic impedances looking into the continuing duct and the absorptive surface are dissimilar, then a correspondingly disproportionate division of the sound energy between the two alternate paths will occur. It is, therefore, an essential feature of this invention to operate over board frequency ranges, including very low frequencies, with a sound absorptive surface having specific acoustic impedance near the characteristic impedance of the fluid, while at the same time providing an input impedance to the continuing duct which differs greatly from the specific characteristic impedance of the fluid especially at lower frequencies.

It is a well known characteristic of boardband sound absorptive materials that, even if properly designed in all other respects, they must be of the order of one-quarter of a wavelength deep in order to first provide an input specific acoustic impedance near the specific characteristic impedance of the fluid. Furthermore, this impedance match must prevail if a large percentage of incident sound energy is to be absorbed. For example, for very efficient absorption of sound at 100 Hertz (Hz), a broadband sound absorber in room temperature air should be about three-quarters of a meter deep. Space for such a depth is seldom available in the radial direction but is usually available in the axial direction.

The input impedance of the continuing duct at low frequencies is a well known cyclic function of duct length. If the continuing duct is well under one-half wavelength, such as one-fourth wavelength, the impedance is mainly due to the inertia of the air column. This is mainly reactive and results in a substantial reflection of sound energy impinging on the entrance. Since the actual value of the input impedance of a length of exhaust duct is a function of its length, it is a well known procedure to "tune" an exhaust pipe by varying its length to obtain some desirable characteristics such as impedance mismatch at its entrance.

At higher frequencies, the input impedance to the continuing duct tends toward the specific characteristic impedance of the fluid and the sound energy partition between the two alternate paths tends to become proportional to their areas in the transverse plane. In many cases, greater high frequency attenuation is desired than can be provided by the maximum area ratio that space permits. However, to attain efficient attenuation of high frequency sound by lining the duct with sound absorptive material does not require much depth because the wavelength of high frequency sound is correspondingly short. Thus, the continuing duct may be provided with an absorptive lining end still be located centrally within the low frequency absorptive structure. This leads to a particularly compact attenuator which functions continuously from as low a frequency as desired to as high a frequency as desired. The design to be preferred for minimal back pressure utilizes a slowly tapering conical diffuser for a plenum, a bellmouth to reaccelerate the flow and locates the continuing duct coaxially with the diffuser, but these mechanical details are subject to very wide variation without changing the essential features of the invention.

For some applications, back pressure is less critical than in others. For example, more back pressure can usually be tolerated by a positive displacement engine such as an internal combustion engine than by a gas turbine. In this case, certain hybrid designs become feasible which incorporate the principles of the present invention in whole or in substantial part but cause the structure as a whole to bear a superficial resemblance to ordinary single or double chamber expansion chambers.

For example, a simple cylindrical chamber may replace the diffuser if the additional back pressure due to the discontinuous flow area can be tolerated. Downstream of the transverse place the structure continues to function in the manner of two disproportionate acoustic paths one of which is also a flow path as previously described. As before, supplemental high frequency attenuation may be provided by lining at least the portion of the continuing duct that lies within the low frequency absorption section.

Finally, the principles of the present invention may be used to significantly improve the type of device known as the double expansion chamber. A typical double expansion chamber comprises a cylindrical tank which is one-half wave length long at some design frequency. It is divided by a transverse partition at the center into two chambers each one-quarter wave length long. The two chambers are connected by a pipe which may be also one-quarter wave length long. The attenuation provided by such a device increases as the diameter of the chambers increases.

The attenuation may be improved and hence the diameter decreased if the principles of the present invention are applied preferably on both sides of the partition. To accomplish this objective, the annular space between the pipe which interconnects the chambers and the outer shell is equipped with the low frequency absorptive structure on both sides of the transverse baffle plate. If supplementary high frequency attenuation is desired, the connecting pipe may be absorptively lined as previously described for the continuing duct. In this form, the attenuation and pressure drop are both independent of the direction of flow.

DETAILED DESCRIPTION OF THE SHOWN EMBODIMENTS

Figure 1:
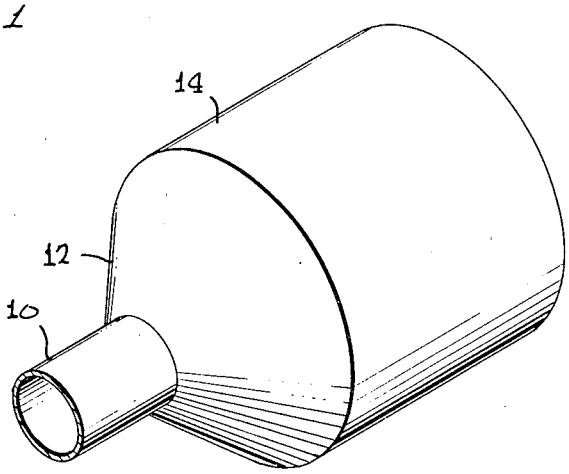
FIG. 1 is an isometric view of an embodiment of the sound attenuator of this invention.

Referring particularly to the drawings, there is shown a gas discharge duct 10 which is depicted as a cylinder but may be any desired shape in cross-section. The duct 10 is connected to a diffuser section 12 which is shown to be basically in the shape of a truncated cone. The duct 10 is integrally connected to the diffuser 12. Although the diffuser 12 is shown as a cone, it is understood to be within the scope of this invention that any desirable diffuser or plenum configuration could be employed.

The diffuser 12 is integrally connected to a cylindrical shell 14 which forms the outer wall of annular chamber 16. The chamber 16 is closed at the outermost end thereof by end wall 18.

An opening 20 is formed within the end wall 18. Connected with the end wall 18 is an outlet duct 22. Gas is to be conducted from the inlet duct 10 through the diffuser 12 and expelled to the ambient air through the outlet duct 22. The innermost edge of the duct 22 is smoothly contoured to form a bellmouth 24. The bellmouth 24 is to offer minimum amount of resistance to the passage of gas into the outlet duct 22.

The wall surface defining the duct 22 is permeable to sound and is shown formed of sheet material which includes a substantial number of openings 26. The openings connect with an annular space 28. The space 28 contains sound absorption means shown as fiberglass and is closed by a cylindrical impermeable thin shell 34.

The innermost end of the annular chamber 16 is closed by a thin permeable plate 32 shown as including a substantial number of small sized openings 33.

The annular chamber 16 contains the low frequency noise absorption means shown as fiberglass. A sound wave progressing from duct 10 toward the duct 22, enters the diffuser 12 and expands across the cross-section of the diffuser. Two alternate routes are available for the sound wave. The sound may pass through the permeable plate 32 or it may enter the duct 22. If the acoustical impedance of these two alternate branches were the same, the acoustical energy of the low frequency sound would be divided in proportion to the relative areas of the plate 32 and the cross-section of the duct 22. The essence of this invention is to provide very different acoustic impedances in the two branches so that most acoustical energy flows through the plate 32 and very little acoustical energy flows into the duct 22.

Because of the extended length of the sound absorbing chamber 16, it is readily possible to provide efficient absorption of low frequency energy. This means that the acoustic impedance at the plate 32 to the incident sound waves may be readily adjusted to be very absorptive.

Low frequency sound entering the central duct 22 encounters a very different acoustic impedance. The length of the duct 22 is small compared to a wave length. As a result, the entire volume of gas in the duct 22 attempts to oscillate as a whole. This causes an inertial reaction, known as inertance, which is highly reflective. The only resistive component to the impedance at the entrance to duct 22 is due to the radiation resistance at the final discharge point. For frequencies in which the radius of the discharge duct is small, compared to a wave length, this radiation resistance is quite small. The net result of this arrangement is that most of the energy in the incident low frequency sound wave enters through the plate 32 and is absorbed.

High frequency sound incident upon plate 32 and the entrance to the duct 22 behaves differently. If the sound absorber within the annular space 16 has been properly designed, the high frequency sound also sees an impedance near optimum and energy enters freely. The impedance at the entrance to duct 22 is also nearly matched to the characteristic impedance of the gas, so the energy partitions in accordance with the relative cross-sectional areas of the two separate paths. The energy which enters the duct 22 is now absorbed to a large extent by the duct wall acoustical treatment which is included within the annular space 28. The annular space 28 is designed in particular for efficient absorption of high frequency sound.

As a result, absorption of both low frequency and high frequency sounds within the gas stream is accomplished. Gaseous pressure drop is minimized by the fact that the sound attenuator of this invention provides for straight through flow. This is due to the fact that the longitudinal center axis of the duct 10 is in alignment with the longitudinal center axis of the duct 22. The use of the diffuser 12 and the bellmouth 24 promotes a minimal pressure drop.

The sound absorptive structures in the annular space 28 and the annular chamber 16 are both shown to be the familiar fiberglass pack provided with a protective perforated sheet facing. Their purpose is only to provide the appropriate acoustic impedance at the perforated surfaces 26 and 32. Any other structure in the annular spaces which will provide the desired input acoustic impedances is equally suitable. Examples are numerous. Acoustic foam may be substituted for the fiberglass. In some cases, the fiberglass can be removed leaving the annular air space empty. If the permeable facing sheets (22 and 32) are selected to have sufficiently limited permeability and thereby a sufficiently high through-flow resistance to the fluid, then the cavity-facesheet combination can provide suitable absorption and dissipation at some frequencies although they are scarcely the broadband absorbers that are most desirable. Finally, the annular air space of chamber 16 and space 28 may be filled with sound absorbing structures such as are described in U.S. Pat. Nos. 3,734,234; 3,831,710; 3,913,702 all by the present inventor. It is also considered within the scope of this invention that any other dissipative sound absorbing structure could be employed within chamber 16 and space 28.

The sound absorptive structure of chamber 16 is addressed primarily to low frequencies and secondarily to high frequency sound both of which are proceeding generally toward the transverse surface of plate 32. The absorptive structure of space 28 is a duct liner addressed almost entirely to the dissipative absorption of higher frequencies. For the purpose of this specification, it is convenient to consider any frequency for which the wavelength is greater than twice the inlet duct diameter as being a low frequency. Conversely, any frequency whose wavelength is less than twice the inlet duct diameter may be considered a high frequency.

Figure 4:
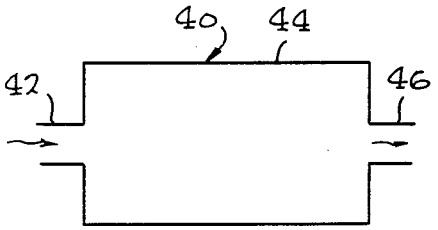
FIG. 4 PRIOR ART
FIG. 4 is a longitudinal cross-sectional view of a typical single chamber expansion chamber well known to the art.

In the past, a common approach to low frequency noise in a duct has been the use of a simple expansion chamber 40 such as is shown in FIG. 4. The inlet duct 42 is connected to tank 44 which is connected with some chosen length of discharge duct 46 which discharges to atmosphere. This expansion chamber device (40) is purely reactive and functions by reflecting incident sound back up the inlet duct (42). It works best at any low frequency for which the chamber (44) is a quarter of a wavelength long or an odd multiple thereof, but fails to attenuate sounds for which the chamber (44) is any multiple of half wavelengths.

Attempts have been made to prevent the half wavelength dropouts in attenuation by lining the chamber (44) with absorptive material. These efforts however, meet with only limited success because there is only room for limited thickness in the radial direction so the liners cannot be tuned to a low enough frequency unless the total diameter becomes excessive.

Figure 2:
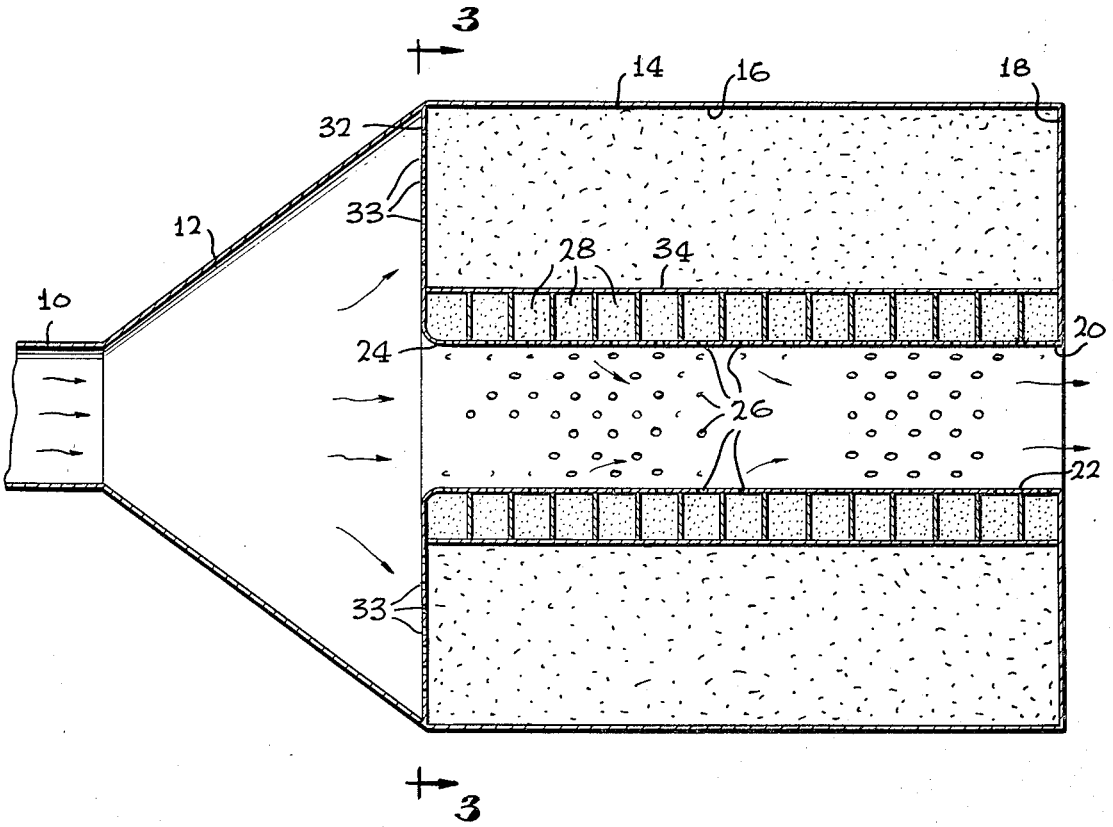
FIG. 2 is a longitudinal cross-sectional view of the sound attenuator of this invention showing the internal constructional arrangement.
Figure 3:
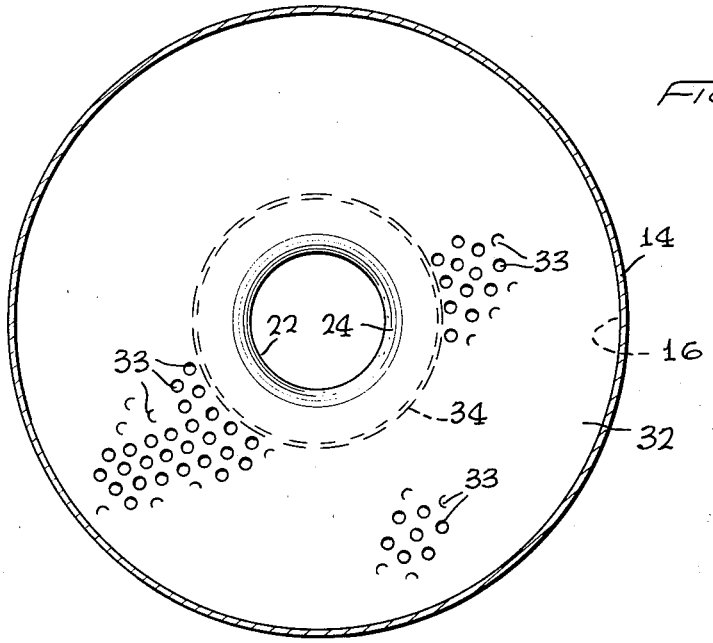
FIG. 3 is a transverse cross-sectional view through the sound attenuator of this invention taken along line 3—3 of FIG. 2.
Figure 5:
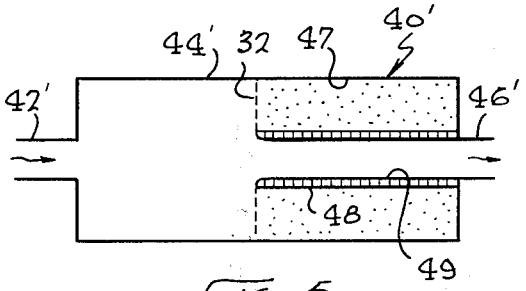
FIG. 5 is a longitudinal cross-sectional view of a second form of the sound attenuator of this invention.

Low frequency absorption can be increased significantly provided the structure of the present invention is incorporated at the discharge end as shown in FIG. 5. Prime numerals have been employed in FIG. 5 to refer to like parts in FIG. 4, as to operating characteristics. Expansion chamber 40' includes annular space 47 which may or may not include an acoustically absorptive material. Space 47 surrounds discharge duct 49. The only difference between the apparatus of FIG. 5 and the apparatus of FIG. 2 is the forming of the plenum chamber as a cylinder instead of a cone shape. This leads to the same attenuation spectrum as is obtained by the attenuator of FIG. 2. There is, however, a penalty of increased pressure drop due to the flow area discontinuity at the entrance to the plenum chamber. The use of the discharge section liner 48 is optional depending on the amount of high frequency attenuation required.

Figure 6:
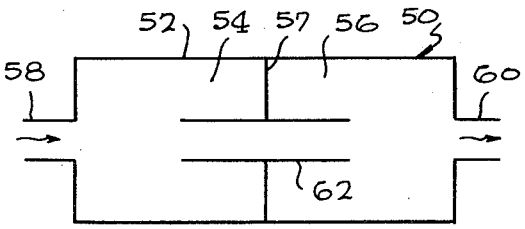
FIG. 6 PRIOR ART
FIG. 6 is a longitudinal cross-sectional view of a typical double chamber expansion chamber well known to the art.

Two chamber expansion chambers are sometimes used to obtain greater attenuation. A typical double expansion chamber 50 is shown in FIG. 6. Chamber 50 includes a tank 52 being divided into a first section 54 and a second section 56 by baffle plate 57. Inlet duct 58 connects with first section 54 and outlet duct 60 connects with second section 56. Pipe 62 interconnects sections 54 and 56. In this case, the details of the response may be varied within wide limits by using unequal lengths of the sections 54 and 56 and by varying the length of the pipe 62. These devices are also purely reactive. Again, addition of relatively thin absorptive liners is of limited usefulness at low frequencies.

Figure 7:
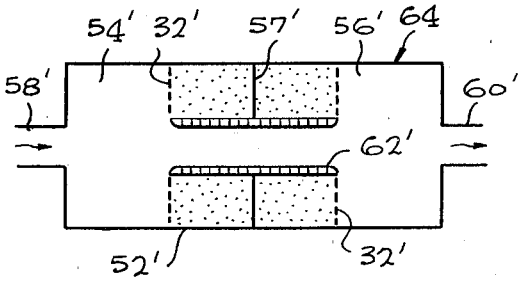
FIG. 7 is a longitudinal cross-sectional view of a third form of the sound attenuator of this invention.

Major improvements in the overall attenuation spectrum may be made by adding the construction of the present invention to preferably both sides of the transverse baffle plate 57 as shown in the expansion chamber 64 in FIG. 7. Again, like numerals with primes have been employed in FIG. 7 to refer to like parts in FIG. 6 as to operating characteristics. Due to its symmetry, both the attenuation and the pressure drop are independent of the direction of flow. As in the case of the single chamber design, as shown in FIG. 5, pressure drops are higher due to flow area discontinuities, unless the plenum chambers are conical, diffuser shaped.

Although superficially similar in external appearance, the ordinary expansion chambers 44 and 50, and the second or third embodiments 40' and 64 of the present invention operate on totally different principles. The expansion chambers 44 and 50 are almost purely reactive, non-dissipative devices, whereas the attenuators 40' and 64 of the present invention depend almost entirely on broadband dissipative absorption of sound. As a result, the dropouts in attenuation characteristic of reactive type devices are absent.

What is claimed is:

1. A sound attenuator for ducts containing fluid flow comprising:

(a) an elongated chamber having a fluid flow inlet and a fluid flow outlet;

(b) a dissipative sound absorptive structure within said chamber having an acoustic input impedance close to the characteristic impedance of said fluid for optimally receiving sound of a given low frequency, said absorptive structure being adapted to attenuate at least said low frequency sound;

(c) duct means within said chamber for allowing the passage of said fluid flow from said inlet to said outlet and having an acoustic input impedance substantially different from the characteristic impedance of said fluid at said low frequency to cause said low frequency sound to be reflected therefrom and to allow high frequency sound to pass therethrough, said sound absorptive structure being arranged with respect to said duct means to receive and attenuate the low frequency sound reflected by said duct means;

whereby sound propagation paths having substantially different input impedances are provided for said low and high frequency sounds.

2. The attenuator of claim 1 wherein said duct means has a length which is small compared to the wavelength of said given low frequency, whereby an inertial reaction is set up within said duct means which causes said substantially different acoustic input impedance and highly reflects said low frequency sound.

3. The attenuator of claim 1 wherein the entrance to said duct means is bellmouth shaped to smoothly accelerate flow of fluid therethrough.

4. The attenuator of claim 1 wherein the inlet portion of said chamber includes a diffuser of gradually increasing cross-sectional area to decelerate the flow of fluid through said chamber.

5. The attenuator of claim 1 wherein said duct means includes means for attenuating said high frequency sound.

6. The attenuator of claim 1 wherein said fluid flow inlet and fluid flow outlet are coaxially disposed with respect to the major axis of said chamber and provide an unobstructed flow passage therethrough.

7. The attenuator of claim 1 wherein said sound absorptive structure and said duct means have coplanar entrances for receiving said high and low frequency sounds.

8. The attenuator of claim 1 wherein the entrance for said sound into said sound absorptive structure is coaxial with the major axis of said chamber.

9. The attenuator of claim 8 wherein said sound absorptive structure has an axial dimension equal to approximately one quarter wavelength of said given low frequency.

10. The attenuator of claim 1 wherein said sound absorptive structure is substantially cylindrical in cross-section and said duct means is substantially cylindrical in cross-section and is coaxial with and within said sound absorptive structure.

11. The attenuator of claim 1 wherein said sound absorptive structure has an absorptive surface facing said fluid flow inlet and further comprising a like second sound absorptive structure having an absorptive surface facing said fluid flow outlet, said duct means extending through said absorptive structures.

12. The attenuator of claim 1 wherein said duct means comprises a permeable-walled pipe, said pipe being encircled by a dissipative sound absorptive material to attenuate said high frequency sound.

13. A broadband sound attenuator for ducts containing fluid flow comprising:

(a) an elongated chamber having a fluid flow inlet and a fluid flow outlet;

(b) a first dissipative sound absorptive structure within said chamber having an acoustic input impedance close to the characteristic impedance of said fluid for optimally receiving sound of a given low frequency, said first absorptive structure being adapted to attenuate said low frequency sound; and (c) a second dissipative sound absorptive structure within said chamber having an acoustic input impedance substantially different from the characteristic impedance of said fluid at said low frequency and adapted to optimally receive sound of a given frequency which is higher than said given low frequency, said second absorptive structure being adapted to attenuate said higher frequency sound and having a length which is small compared to the wavelength of said given low frequency to set up within said second absorptive structure an inertial reaction which causes said substantially different acoustic input impedance and highly reflects low frequency sound, said first absorptive structure being arranged with respect to said second absorptive structure to receive and attenuate the low frequency sound reflected by said second absorptive structure;

whereby sound propagation paths having substantially different input impedances are provided for said low and high frequency sounds.

14. A broadband sound attenuator for ducts containing fluid flow comprising:

(a) an elongated chamber having a fluid flow inlet and a fluid flow outlet, each being coaxially disposed with respect to the major axis of said chamber and providing an unobstructed flow passage therethrough;

(b) a first dissipative sound absorptive structure having an acoustical impedance which is optimal for receiving a given low frequency within said chamber;

(c) said sound absorptive structure having an acoustical impedance close to the characteristic impedance of the fluid;

(d) the entrance for sound energy into said first sound absorptive structure being coaxial with said major axis of said chamber; and (e) a second dissipative sound absorptive structure having an acoustical impedance which is optimal for receiving a given frequency which is higher than said given low frequency within said chamber, the entrance for said sound energy into said second sound absorptive structure being coplanar with respect to the entrance into said first sound absorptive structure;

(f) said second sound absorptive structure including a central duct having a length which is small compared to the low frequency wave length, whereby an inertial state within the duct is set-up which is highly reflective to low frequency wave;

(g) said first and second dissipative sound absorptive structures having substantially different acoustical impedances.

15. The sound attenuator as defined in claim 14 wherein said entrance to said second dissipative sound absorptive structure is bellmouthed shaped to smoothly accelerate flow of fluid therethrough.

16. The sound attenuator as defined in claim 14 wherein said first dissipative sound absorptive structure is substantially cylindrical in cross-section, said second dissipative sound absorptive structure is substantially cylindrical in cross-section and is concentric with said dissipative sound absorptive structure.

17. The sound attenuator as defined in claim 14 wherein the inlet portion of said chamber includes a diffuser of gradually increasing cross-sectional area to decelerate the flow of fluid through said chamber.

18. A broadband sound attenuator for cylindrical ducts containing fluid flow comprising:

(a) an elongated chamber having a fluid flow inlet and a fluid flow outlet each being coaxially disposed with respect to the major axis of said chamber and providing an unobstructed flow passage therebetween;

(b) a first dissipative sound absorptive structure having an absorptive surface facing said fluid flow inlet and adapted to absorb sound of a wave length greater than twice the average diameter of said inlet, said dissipative sound absorptive structure being located within said chamber;

(c) said sound absorptive structure having an acoustical impedance close to the characteristic impedance of the fluid;

(d) a second dissipative sound absorptive structure having an absorptive surface facing said fluid flow outlet and adapted to absorb sound of a wavelength greater than twice the average diameter of said inlet, said dissipative sound absorptive structure being located within said chamber; and (e) a permeable-walled pipe coaxially disposed within said chamber and extending through said first and second dissipative sound absorptive structures to provide an unobstructed flow passage between said fluid flow inlet and said fluid flow outlet, said pipe being encircled by a dissipative sound absorptive material;

(f) said permeable-walled pipe having a length which is small compared to the low frequency wave length whereby an inertial state within the duct is set up which is highly reflective to low frequency waves.

19. The sound attenuator as defined in claim 18 wherein said first and second dissipative sound absorptive structures are substantially cylindrical in cross-section, said permeable-walled pipe is substantially cylindrical in cross-section, and said inlet and outlet are concentric with said dissipative sound absorptive structures and said pipe.

* * * * *